US005135218A

United States Patent [19]

McGovern

[11] Patent Number: 5,135,218

[45] Date of Patent: Aug. 4, 1992

[54] POOL GAME TABLE

[76] Inventor: James R. McGovern, 205 E. 239th St., Bronx, N.Y. 10470

[21] Appl. No.: 633,392

[22] Filed: Dec. 21, 1990

[51] Int. Cl.[5] ..... A63D 15/00

[52] U.S. Cl. ..... 273/3 A; 273/4 A; 273/9

[58] Field of Search ..... 273/2, 3 R, 3 A, 3 B, 273/4 R, 14

[56] References Cited

U.S. PATENT DOCUMENTS

| | | | |
|---|---|---|---|
| D. 160,582 | 10/1950 | De Voy | 273/3 R |
| 1,070,592 | 8/1913 | Fay | 273/4 R |
| 1,669,822 | 5/1928 | Gregg | 273/3 R |
| 4,147,345 | 4/1979 | McGovern | 273/3 A |
| 4,927,140 | 5/1990 | Pappas | 273/4 R |

FOREIGN PATENT DOCUMENTS

| | | | |
|---|---|---|---|
| 3501319 | 7/1986 | United Kingdom | 273/2 |
| 1519725 | 11/1989 | United Kingdom | 273/3 A |

*Primary Examiner*—Theatrice Brown

[57] ABSTRACT

An improved circular pool table comprised of a flat surface rimmed by a ball rebound cushion comprised of a plurality of rubber tipped bumper segments, any one of which can be pivoted to an upright position to expose a segment pocket. Each segment is combined with a rotatable ring which encircles the playing surface and which carriers a plurality of tabs which correspond with a bumper segment. Each tab is provided with game point indicia to display game point values and is in 1 to 1 correspondence with a respective segment. Each time the ring is rotated the point value associated with each segment/pocket is changed. When a bumper segment is disposed horizontally the line of sight to its tab is blocked by a flap that is fastened to the bottom of each bumper segment, and when a segment is raised to a vertical position to form a segment/pocket the line of sight to its corresponding tab is unobstructed and the point value associated with the pocket is visible and readable.

4 Claims, 5 Drawing Sheets

A SUGGESTED GAME POINT AWARD TAB FACE MARKING PLAN EMBODIMENT

| TAB (SEGMENT No.) | BACKGROUND COLOR | LEFT SIDE | CENTER | RIGHT SIDE |
|---|---|---|---|---|
| 1 | BLU. | 2 | ★ | 16 |
| 2 | | 5 | 12 | 19 |
| 3 | OR. | 1 | 8 | 15 |
| 4 | GR. | 3 | 10 | 17 |
| 5 | | 6 | 13 | 20 |
| 6 | BLK. | 4 | 11 | 18 |
| 7 | YELL. | 7 | 14 | 21 |
| 8 | MAR. | 2 | 9 | 16 |
| 9 | | 5 | 12 | 19 |
| 10 | OR. | 1 | 8 | 15 |
| 11 | | 3 | 10 | 17 |
| 12 | | 6 | 13 | 20 |
| 13 | RED | 4 | 11 | 23 |
| 14 | GR. | 7 | 14 | 21 |
| 15 | PUR. | 2 | 9 | 21 |
| 16 | | 5 | 12 | 19 |
| 17 | MAR. | 1 | 8 | 15 |
| 18 | | 3 | 10 | 17 |
| 19 | BLU. | 6 | 13 | 20 |
| 20 | OR. | 4 | 11 | 18 |
| 21 | | 7 | 14 | 21 |
| 22 | GR. | 2 | ★ | 16 |
| 23 | | 5 | 12 | 19 |
| 24 | MAR. | 1 | 8 | 15 |
| 25 | RED | 3 | 10 | 17 |
| 26 | | 6 | 13 | 20 |
| 27 | GR. | 4 | 11 | 18 |
| 28 | | 7 | 14 | 21 |
| 29 | OR. | 2 | 9 | 16 |

BLACK = 8
MAROON = 7
GREEN = 6
ORANGE = 5
PURPLE = 4
RED = 3
BLUE = 2
YELLOW = 1

POINT VALUE OF TAB BONUS COLOR BACKGROUNDS

| TAB (SEGMENT No.) | BACKGROUND COLOR | LEFT SIDE | CENTER | RIGHT SIDE |
|---|---|---|---|---|
| 30 | | 5 | 12 | 21 |
| 31 | BLK. | 1 | 8 | 15 |
| 32 | PUR. | 3 | 10 | 21 |
| 33 | BLU. | 6 | 13 | 20 |
| 34 | | 4 | 13 | 18 |
| 35 | OR. | 7 | 14 | 21 |
| 36 | RED. | 2 | 13 | 16 |
| 37 | GR. | 5 | 12 | 19 |
| 38 | | 1 | 11 | 19 |
| 39 | MAR. | 3 | 10 | 17 |
| 40 | | 6 | 13 | 20 |
| 41 | OR. | 4 | 11 | 18 |
| 42 | YELL. | 7 | 14 | 21 |
| 43 | | 2 | 9 | 26 |
| 44 | GOLD | 5 | ★ | 19 |
| 45 | BLK. | 1 | 8 | 26 |
| 46 | BLU. | 3 | 4 | 21 |
| 47 | GR. | 6 | 13 | 20 |
| 48 | PUR. | 4 | 11 | 18 |
| 49 | YELL. | 7 | 14 | 21 |
| 50 | MAR. | 2 | 9 | 16 |
| 51 | GR. | 5 | 12 | 19 |
| 52 | YELL | 1 | 8 | 15 |
| 53 | BLU. | 3 | 11 | 17 |
| 54 | PUR. | 6 | 13 | 20 |
| 55 | | 4 | 11 | 18 |
| 56 | BLU. | 7 | ★ | 21 |
| 57 | GR. | 2 | 9 | 17 |
| 58 | YELL | 5 | 12 | 19 |

OTHER STARS = 14 = 9
CHEVRON = 2 BAR = 1
TRIANGLE = 3
SQUARE = 4
OPEN RING = ANOTHER TURN
GOLD STAR = 25
OPEN STAR = 5

POINT OR ADVANTAGE VALUE OF TAB BONUS SYMBOLS

| TAB (SEGMENT No.) | BACKGROUND COLOR | LEFT SIDE | CENTER | RIGHT SIDE |
|---|---|---|---|---|
| 59 | | ☆ | 8 | 21 |
| 60 | GR. | 3 | 10 | 17 |
| 61 | | 6 | 13 | 21 |
| 62 | | 4 | 11 | 18 |
| 63 | | 7 | 14 | 21 |
| 64 | BLK. | 2 | 9 | 20 |
| 65 | OR. | 5 | ★ | 19 |
| 66 | | 1 | 8 | 20 |
| 67 | YELL. | 3 | 10 | 17 |
| 68 | BLU. | 6 | 13 | 20 |
| 69 | | 4 | 13 | 18 |
| 70 | OR. | 7 | 14 | 21 |
| 71 | MAR. | 2 | 13 | 17 |
| 72 | PUR. | 5 | 12 | 19 |
| 73 | GR. | 1 | 8 | 17 |
| 74 | | 3 | 10 | 21 |
| 75 | RED | 6 | 13 | 20 |
| 76 | OR. | 4 | 11 | 19 |
| 77 | BLU. | 7 | 14 | 21 |
| 78 | | 2 | 10 | 21 |
| 79 | BLK. | 5 | 12 | 19 |
| 80 | | 1 | 8 | 21 |
| 81 | GR. | 3 | 10 | 18 |
| 82 | PUR | 6 | 13 | 20 |
| 83 | MAR. | 4 | 11 | 18 |
| 84 | BLU. | 7 | 14 | 21 |
| 85 | | 2 | 9 | 18 |
| 86 | OR. | 5 | 12 | 19 |
| 87 | GR. | 1 | 8 | 18 |

FIG. 6

POOL GAME TABLE

BACKGROUND OF THE INVENTION

This invention relates to billiard gaming devices but more specifically it relates to an apparatus that is used to play a game of pool.

The present state of the art, the Round Pool Table, provides a game table where a number of segments can be disposed vertically to form a pocket that an object ball can be sunk in for a given game point. This arrangement is suitable for playing a slow and simple game, but it is not capable of generating strong player interest.

The present invention, however, provides that a player can change the game point values associated with the tables prospective pockets while a game is in progress. It provides that the point award, and this would include numerous bonus award possibilities, is disclosed in an ongoing and surprising fashion, when the player elevates a segment to form a pocket that can be used to sink an object ball in.

SUMMARY OF THE INVENTION

A primary object of the invention is to provide a pool game apparatus that overcomes the shortcomings of the state of the art Round Pool Table.

Another object is to provide a game apparatus where a pocket can be formed by disposing a single table segment in a vertical attitude.

A further object is to provide a game apparatus where the segments of the table are consecutively numbered to provide easy identification of prospective segment/pockets.

A still further object is to provide a game apparatus where various numbered game points and bonus game points are displayed on tabs that are carried by a manually rotateable game point ring around the circumference of the table's playing area so that game points can be variably associated with the prospective segment-/pockets of the table.

The embodiment of the tab markings plan for the present invention may specify a random selection of game point values that are to be displayed on the tabs of the game point ring, however in the tab markings plan suggested in the preferred embodiment, each tab face displays three individual point value marks so that each formable segment/pocket of the table has three possible point awards associated with it.

This marking plan would provide a system wherein a player could choose to project an object ball into a pocket formed from any one of three adjacent segments, the first being the easiest, the segment in direct alignment with the cue ball and an object ball, the second being more difficult, the segment adjacent the first, and the third being most difficult, the segment adjacent the second.

The point values displayed on the tab adjacent the segment/pocket used to sink the ball in range from, a low point value, awarded for easiest type shot, to, the highest point value, awarded for most difficult type shot.

A still further object is to provide a game apparatus where an opaque flap is provided attached to the underside of each segment so that while the segment is disposed horizontally the flap obstructs the line of sight to the tab that is adjacent the segment, and when the segment is elevated and disposed vertically, to form a pocket, the line of sight to the tab is open and the game points displayed on the tab become disclosed and are readable.

A still further object is to provide a game apparatus where a player can manually rotate the game point ring by the use of a detachable handle.

Other objects of the invention will become apparent as the description thereof progresses.

In order to accomplish the above and related objects of the invention, its embodied form could be produced by one's reference to the accompanying drawings, keeping in mind that changes could be made in the actual construction as it is shown and described within the scope of the appended claims.

DESCRIPTION OF THE DRAWINGS

FIG. 6 shows a-game point award tab face marking plan embodiment that can be used on the Improved Round Pool Table to play a suggested pool game.

PREFERRED EMBODIMENT

Figure 2A:
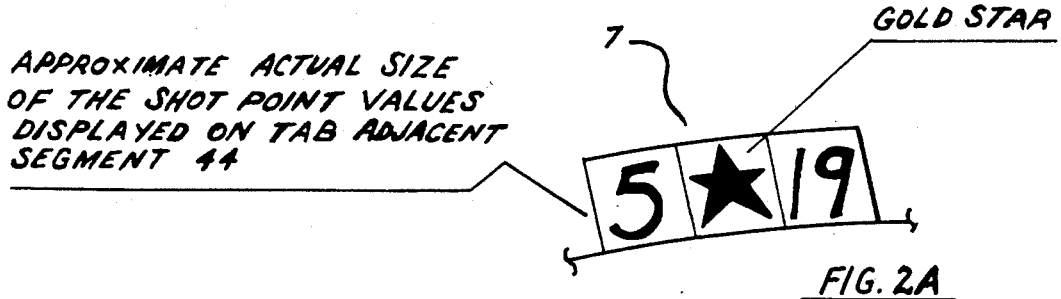
FIG. 2A shows an enlarged view of a game point ring tab and the shot point value markings displayed on the face of the tab.
Figure 1:
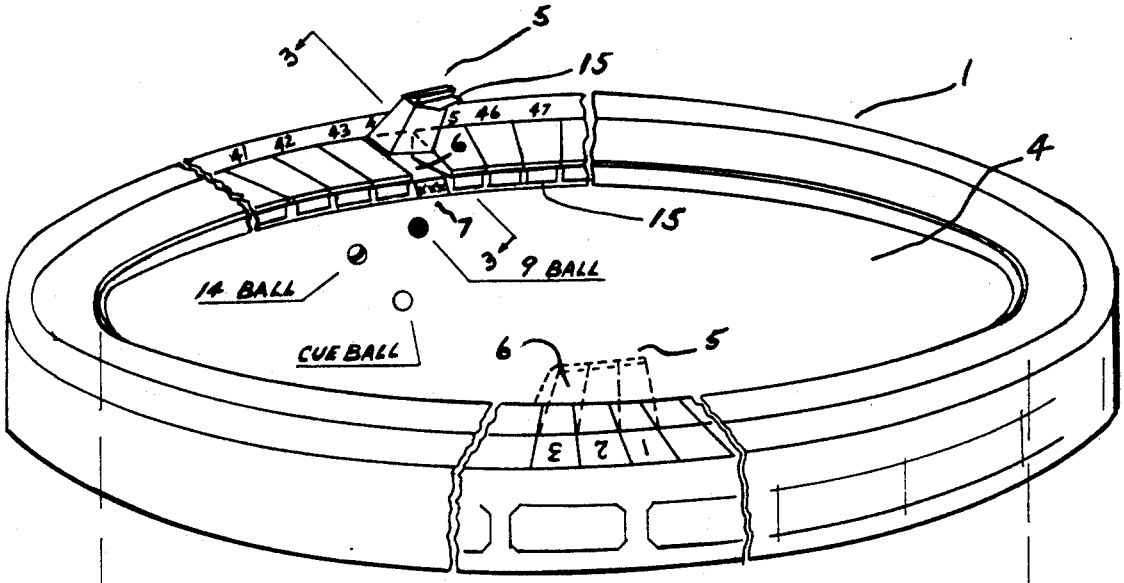
FIG. 1 is a pictorial illustration of the concept of combining a round pool table and a game point ring.
Figure 2:
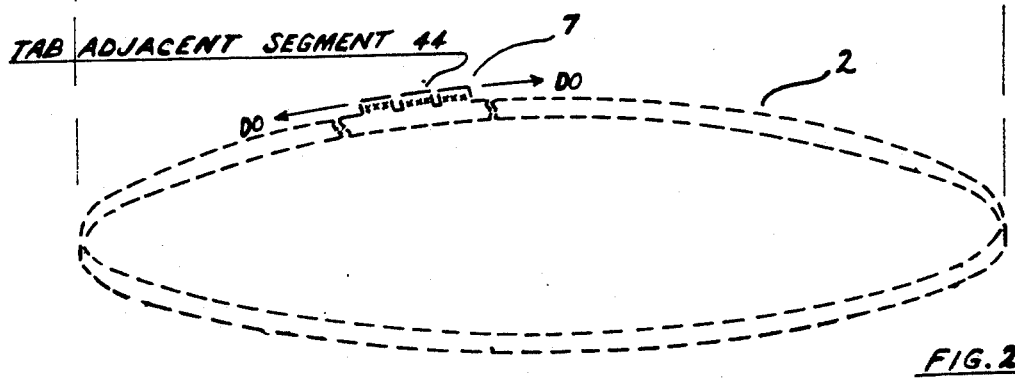
FIG. 2 is an illustrated simulation of a table game point ring.

Please refer to FIG. 1 and to FIG. 2

Note 1. Although accessory pool game means such as 15 standard pool balls, a cue ball, a ball rack, standard pool cues, and score keeping bead lines are necessary for playing a game of pool on the new apparatus provided in this new invention, these items have not been included in the drawings of the invention.

Continuing, in manufacture make a prototype of the present invention by providing a round pool table 1 such as is specified and claimed in U.S. Pat. No. 4,147,345.

Make the table so that the playing area 4 measures approximately 75 inches in diameter. This size playing area 4 will yield an arrangement that provides 87 cushioned segments 5. It will also provide that each segment 5 will be wider than a standard 2.25 inch diameter pool ball. It will further provide that a pocket 6 that said ball can be sunk in, will be formed by elevating any one given segment 5 so that it is disposed vertically.

Consecutively number the segments 5 of the table 1 so that there is a number identification for each possible table pocket 6.

As is shown in FIG. 2, provide a rotateable game point indicator ring 2. FIG. 2 shows a simulated version of a game point ring 2. The ring 2 resembles a large hoop. It could be made of plastic. The ring 2 is larger in diameter than the table's playing area 4.

Provide the ring 2 with 87 game point indicator tabs 7. The ring 2 carries one tab 7 for each table segment 5.

Please refer to FIG. 2A

FIG. 2A shows an enlarged view of the face of a tab 7. This particular tab face illustration shows two numerical game point markings and one bonus symbol 8 game point mark.

The game point markings shown on the tab face are awarded for sinking a ball in the pocket 6 the tab 7 corresponds to.

A tab 7 resembles a flat piece of stock plastic material with one of its ends bent to about 10 degrees off the vertical. This can be seen in FIG. 3.

The top leg of the angled tab 7 should be flexible. It projects above the level of the table's playing area 4 surface. When a ball is projected past a tab 7, the tab is bent over and then flexes back to a near vertical attitude. Provide a tab bracket 9 for each tab 7.

Figure 5:
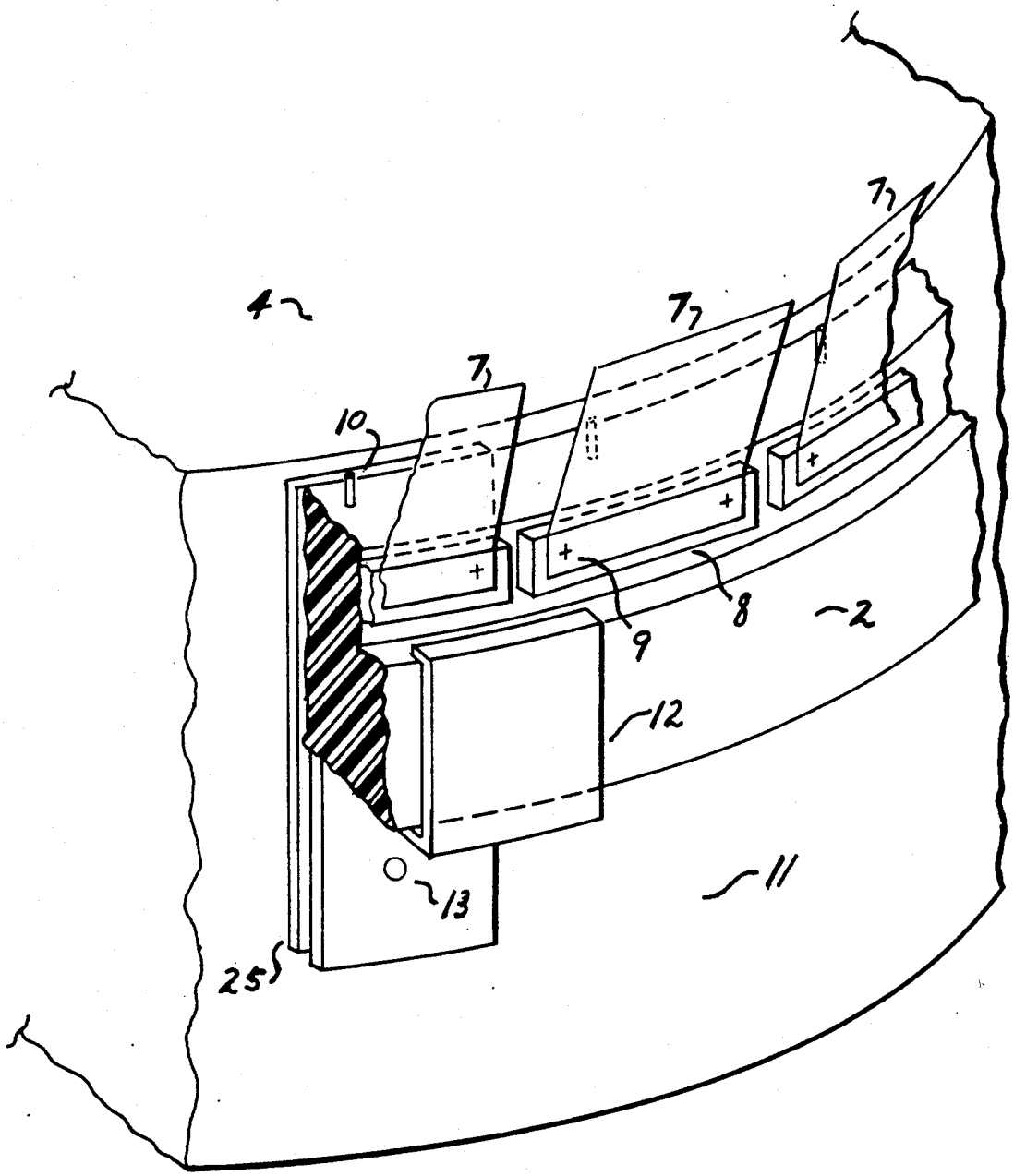
FIG. 5 is a section thru line 5—5 of FIG. 3 that shows perspectively how the game point ring is fastened to the vertical support of the table's playing surface.

A tab bracket 9 resembles a rectangular bar that is concave on one side and flat on the opposite side. This can be seen in FIG. 5. Space the brackets 9 apart around the outer surface of the ring 2. Center each bracket 9 on the centerline of a given segment 5. The curved surface of a bracket 9 is placed horizontally against the outer surface of the game point indicator ring 2. The bracket could be glued to the ring 2 surface. The bottom vertical leg of the angled tab 7 is placed against the flat surface of its bracket 9. The tab 7 could be fastened to the bracket 9 by a screw 10.

Provide a plurality of vertical leverage pins 11. This can be seen in FIG. 5.

Set each pin 11 so that it extends vertically up from the top surface of the game point ring 2. Center each pin 11 horizontally on the vertical centerline of the adjacent tab 7. The top of a pin 11 is below the level of the table's playing area 4 surface.

The leverage pins 11 are engaged by a player using a detachable handle 3. The handle 3 is used to manually rotate the game point indicator ring 2. Please refer to FIG. 5 and note that the game point ring 2 is supported to the vertical support 12 of the table's playing area 4 by a plurality of Z brackets 12.

Note that a Z bracket's 12 top leg has a horizontal lip to contain the ring 2.

Space the brackets 12 around the circumference of the playing surface's vertical support 11.

The Z bracket 12 and its spacer plate 25 are curved in shape so that they are compatable with the curvature of the table's vertical support member 11 and the game point ring 2.

Fasten a Z bracket 12 and its spacer plate 25 by thru bolt 13 and nut 14. The game point ring 2 is contained loosely by the brackets 12 so that it can be easily rotated manually in either a clockwise or counterclockwise direction.

Figure 3:
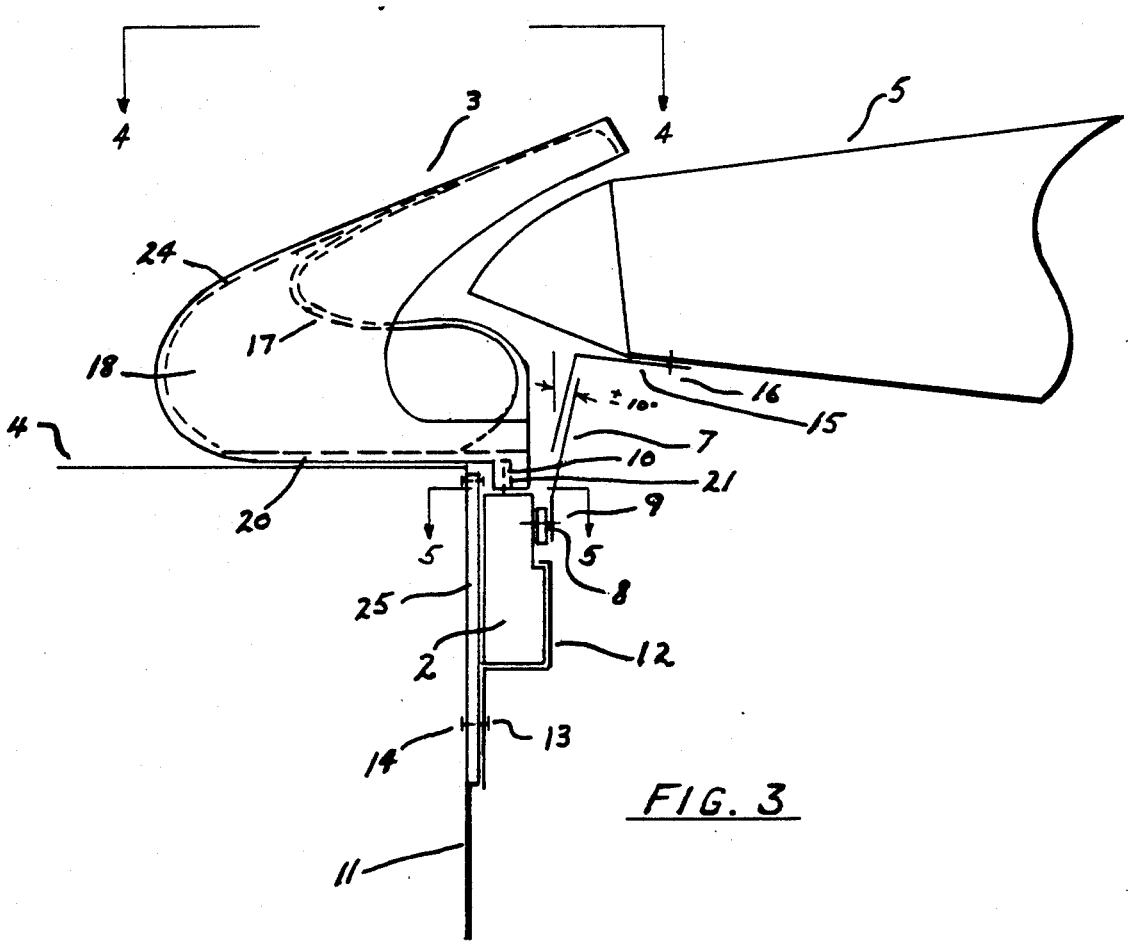
FIG. 3 is a section thru line 3—3 of FIG. 1 that is combined with an elevation of a handle that is used to manually engage the game point ring and rotate it.

Provide a tab flap 15 for each tab 7. This is shown in FIG. 3. A tab flap 15 is angular in shape. It is opaque. Fasten a tab flap 15 to the underside of the cushion end of each segment 5 by screw 16. A flap 15 blocks the line of sight to a tab 7 when the segment 5 it is fastened to is in a horizontal attitude.

When a segment 5 is elevated to form a pocket 6, the point values and other data printed on the face of the segment's corresponding tab 7 are disclosed.

Figure 4:
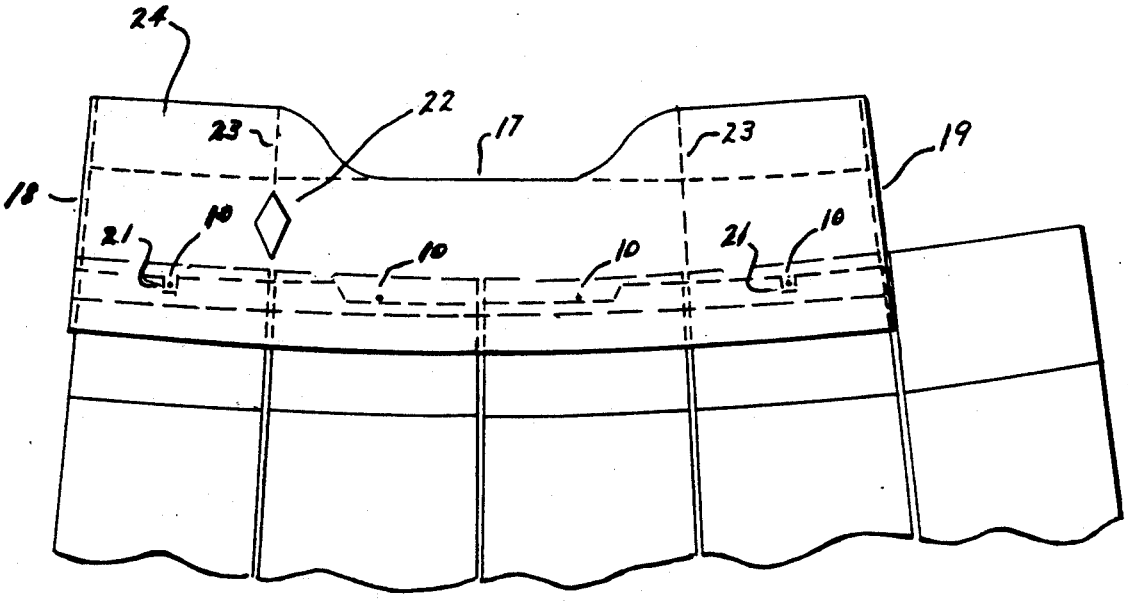
FIG. 4 is a plan view drawing of a handle as it engages pins projecting from the top of the game point ring.

Referring again to FIG. 3, and also to FIG. 4, provide as shown, a detachable handle 3 for manually rotating the game point ring 2 around the circumference of the playing surface 4 of the table 1. Make the handle by supporting a contoured hand grip between two vertical end members 18 and 19.

A horizontal rib 20 connects the bottom ends of members 18 and 19. The rib 20 extends vertically downward along its length dimension on the side opposite the hand grip 17.

Two interior vertical structural rib members 23 provide frontal stability to the hand grip 17.

A wraparound enclosure piece 24 is laid over and connects the top ends of vertical member end pieces 18 and 19, the vertical structural rib members 2 and the top side of the hand grip 17.

Cut a vertical slot 21 in each end of the vertical downward extensions of the rib 20, and provide a pointer like reference marker 22 on the top surface of the enclosure piece 24 of the handle 3.

The player engages the leverage pins 10 of the ring 2 with the handle's slots 21, and slides the handle 3 clockwise or counterclockwise to rotate the game point ring 2. He thus changes the association of game point values with each pocket 6 that can possibly be formed on the round pool table 1.

Please refer to FIG. 6.

The embodiment of the improved round pool table 1 can include the point value markings that are to be displayed on each tab 7 that is carried by the game point indicator ring 2.

In one suggested embodiment these point value markings could be derived by a random means of selection, and placed at random on the tabs of the game point indicator ring 2.

In another suggested embodiment these markings could be planned and placed by design. And so it is in light of this that a suggested plan and placement chart of these markings is presented in FIG. 6.

It is suggested that each tab can display three game point value marks. Note that FIG. 2A shows this in displaying a 5 point value, a gold star value, and a 19 point value in its markings.

Again referring to FIG. 6 note that the tab markings can include numerical point values, see segment/tab 2, bonus background color values, see segment/tab 4, and bonus symbol values, see segment/tab 59. Markings can include point values in various combinations, see segment/tab 7.

It is suggested that in a game, a player can elect to try to sink an object ball in an easy pocket 6, in one that is more difficult, or one that is extremely difficult.

Accordingly, the game point award value can correspond to/the degree of difficulty of a given shot. An easy shot can earn a low point value, and a difficult shot can earn a higher point value.

Please refer again to FIG. 1.

Note the disposition of the 9 ball. It is suggested that the 9 ball can be sunk in segment/pocket 44, 45, or 46, and the point award for these shots can be noted on the segment/tabs that correspond to these pockets.

Sinking the 9 ball in 44 can earn the tab left side value—5 game points. Sinking the 9 ball in 45 can earn the/tab center value—8 game points plus 8 background color bonus points plus another turn for the open ring. Sinking the 9 ball in 46 can earn the/tab right side value—17 points. The 9 ball in 46 is the most difficult of the three shots. It also earns the highest game point award.

Note the disposition of the 14 ball. It is suggested that the 14 ball can be banked into a pocket 6 that consists of segment/pockets 1,2, and 3 in combination, or into segment/pockets 1 and 2 in combination, or into segment/pocket 1. The point award for these bank shots can be noted on the segment/tabs that correspond to these pockets.

Banking the 14 ball into pocket combination 1, 2, and 3 can earn the highest left side value shown on corresponding tabs 1, 2, and 3. The 5 game points shown on tab 2 is the highest value.

Banking the 14 ball into pocket combination 1 and 2 can earn the highest center value shown on corresponding tabs 1 and 2. The 12 game points shown on tab 2 is the highest value. And banking the 14 ball into segment-/pocket 1 can earn the 16 game points shown on the right side of corresponding tab 1. Banking the 14 ball into 1 is the most difficult of the three shots. It also earns the highest game point award.

It is therefore finally suggested that the use of a designed point value marking plan and placement chart can provide a novel system for playing a given pool game on the improved round pool table.

While the improved round pool table game apparatus of the present invention has been shown in connection with a designed point value markings plan and placement chart, it should be understood that the invention is not limited to the particular plan embodiment shown and may vary readily within the limits set forth in the appended claims.

I claim:

1. An improved pool table comprising, a pool table having a circular playing surface, a vertically upstanding circular wall member completely encircling said playing surface, said wall member being spaced from the periphery of said playing surface to define an annular ball drop area therebetween, said ball drop area extending below the level of said playing surface; a plurality of arcuate bumper segments arranged around the entire periphery of said playing surface, said bumper segments being pivotally mounted to said wall member, each of said bumper segments being manually pivotable independently of each other from a horizontal position overlying said ball drop area and forming a ball rebound cushion to a vertical position to form a pocket with said ball drop area for a ball rolling on said playing surface, said bumper segments being functional to prevent a ball from being projected from said playing into said ball drop area when all of said bumper segments are horizontal and further been functional to permit a ball to be projected into said ball drop area when any one of said bumper segments is disposed vertically;

in combination with the improvement of;

a rotatable game point ring assembly comprised of a ring member which completely encircles said playing surface, bracket means attaching said ring member to said vertical support intermediate said vertical support and said wall member and for allowing manual rotation of said ring member in a substantially horizontal plane about said playing surface;

a plurality of substantially vertically extending flexible tabs attached to said ring member, each said tab being in alignment with a respective one of said plurality of arcuate bumper segments, each of said tabs having game point number indicia, bonus point background colors and bonus point symbols for conveying a point value associated with a pocket formed when a said bumper segment is in a said vertical position;

an opaque line of sight obstruction flap is attached to the underside of each said bumper segments, whereby the line of sight to the tab corresponding to a said bumper segment is blocked when said bumper segment is in said horizontal position, and when said bumper segment is pivoted to said vertical position said line of sight to said tab in unobstructed and game points are displayed on said tab;

a plurality of pins extending vertically upwards from said ring member; a detachable handle means for manually engaging said pins whereby said ring can be rotated; and reference mark on said handle for providing alignment of said tabs with said flaps so that when said ring is rotated and stopped with said handle reference mark in alignment with a space between any two adjacent bumper segments, the line of sight to each said tab is blocked by said flap on its corresponding bumper segment.

2. The improved round pool table of claim 1 wherein each said bumper segment is consecutively numbered so that when said bumper segment is a pocket formed vertically disposed said bumper segment will be identified by a reference number.

3. The improved round pool table of claim 1 wherein said flexible tabs will bend from the substantially vertical when a projected ball passes over it and then flex back to its substantially vertical position.

4. The improved round pool table of claim 1 wherein said tabs are interchangeable, revisable, and replaceable.

* * * * *